US007160153B1

(12) United States Patent
Huang

(10) Patent No.: US 7,160,153 B1
(45) Date of Patent: Jan. 9, 2007

(54) ELECTRICAL CONNECTOR

(76) Inventor: George Ying-Liang Huang, 9 Studebaker, Irvine, CA (US) 92618

( * ) Notice: Subject to any disclaimer, the term of this patent is extended or adjusted under 35 U.S.C. 154(b) by 0 days.

(21) Appl. No.: 11/234,274

(22) Filed: Sep. 26, 2005

(51) Int. Cl.
*H01R 13/648* (2006.01)

(52) U.S. Cl. ..... 439/610

(58) Field of Classification Search ..... 439/607–610
See application file for complete search history.

(56) References Cited

U.S. PATENT DOCUMENTS 5,092,794 A * 3/1992 Kachlic ..... 439/607
6,328,588 B1 * 12/2001 Tsai et al. ..... 439/352
6,341,986 B1 * 1/2002 Ko ..... 439/610
6,354,879 B1 * 3/2002 Plehaty ..... 439/610
6,508,671 B1 * 1/2003 Ko ..... 439/610
6,659,801 B1 * 12/2003 Nishio et al. ..... 439/610
6,929,512 B1 * 8/2005 Lai ..... 439/610
2004/0266266 A1 * 12/2004 Lai ..... 439/610
2005/0186847 A1 * 8/2005 Huang et al. ..... 439/610

* cited by examiner

*Primary Examiner*—Gary F. Paumen
(74) *Attorney, Agent, or Firm*—Berenato, White & Stavish

(57) ABSTRACT

An electrical connector includes a connecting unit having a conductive terminal disposed in a sleeve end portion of a dielectric seat, and a metal shielding sleeve disposed around and covering the sleeve end portion of the dielectric seat. A metal shielding housing has an opening for access into an accommodating space thereof and permitting extension of a coupling end portion of the dielectric seat into the accommodating space via the opening for connection with the coupling end portion of the dielectric seat. The metal shielding sleeve projects from an intermediate metal sleeve connected electrically to both the metal shielding sleeve and the metal shielding housing.

8 Claims, 4 Drawing Sheets

ELECTRICAL CONNECTOR

BACKGROUND OF THE INVENTION

1. Field of the Invention

The invention relates to an electrical connector, more particularly to an electrical connector capable of providing an enhanced electromagnetic interference shielding effect.

2. Description of the Related Art

With the growing popularity of high-frequency digital electronic equipment, electromagnetic interference (EMI) and radio frequency interference (RFI) not only interfere with operation of the electronic equipment, but may also harm human bodies. Therefore, it is desirable to make the electronic equipment electromagnetically compatible with the environment so as to minimize EMI and RFI.

FIGS. 1*a* to 1*c* illustrate a fabrication procedure of a conventional electrical connector 1 including a dielectric seat 11, a metal shielding sleeve 13, a plurality of conductive terminals 12, an inner insulating sleeve 14, a metal shielding housing 15, and an outer insulating housing 16. The dielectric seat 11 has a sleeve end portion 111, and a coupling end portion 112 opposite to the sleeve end portion 111. The metal shielding sleeve 13 is disposed around and covers the sleeve end portion 111 of the dielectric seat 11. The conductive terminals 12 are mounted in the sleeve end portion 111, and are spaced apart from each other. Each conductive terminal 12 has a coupling end extending outwardly of the coupling end portion 112 of the dielectric seat 11 and coupled electrically to a cable 2. The inner insulating sleeve 14 is formed by injection molding, and is connected to the coupling end portion 112, as shown in FIG. 1*b*. The metal shielding housing 15 is made of a copper foil, and is disposed around and covers the coupling end portion 112 of the dielectric seat 11 and the inner insulating sleeve 14 for EMI/RFI shielding, as shown in FIG. 1*b*. The outer insulating housing 16 is formed by injection molding, and is sleeved on and entirely covers the metal shielding housing 15, as shown in FIG. 1*c*.

It is noted that the metal shielding housing 15 does not cover the entire dielectric seat 11, and only makes the little contact of the metal shielding sleeve 13, thereby forming a gap therebetween. As such, the conventional connector 1 cannot ensure EMI/RFI shielding. Furthermore, the inner insulating sleeve 14 and the outer insulating housing 15 formed by injection molding are thick, thereby resulting in a relatively large size for the conventional connector 1.

SUMMARY OF THE INVENTION

Therefore, the object of the present invention is to provide an electrical connector having a metal shielding sleeve, a metal shielding housing and an intermediate metal sleeve that cooperate to impart an enhanced electromagnetic interference shielding effect.

According to the present invention, an electrical connector comprises:

a connecting unit including a dielectric seat having a sleeve end portion that is formed with a terminal-receiving space and that has opposite first and second open ends for access into the terminal-receiving space, and a coupling end portion connected fixedly to the first open end of the sleeve end portion, a conductive terminal disposed in the terminal-receiving space in the sleeve end portion of the dielectric seat, the conductive terminal having a first conducting end portion extending toward the second open end of the sleeve end portion, and a second conducting end portion opposite to the first conducting end portion and extending outwardly of the first open end of the sleeve end portion, and a metal shielding sleeve disposed around and covering the sleeve end portion of the dielectric seat;

a metal shielding housing formed with an accommodating space and having an opening for access into the accommodating space, the metal shielding housing permitting extension of the coupling end portion of the dielectric seat into the accommodating space via the opening for connection with the coupling end portion of the dielectric seat; and an intermediate metal sleeve connected electrically to both the metal shielding sleeve of the connecting unit and the metal shielding housing, the metal shielding sleeve projecting from the intermediate metal sleeve.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1A:
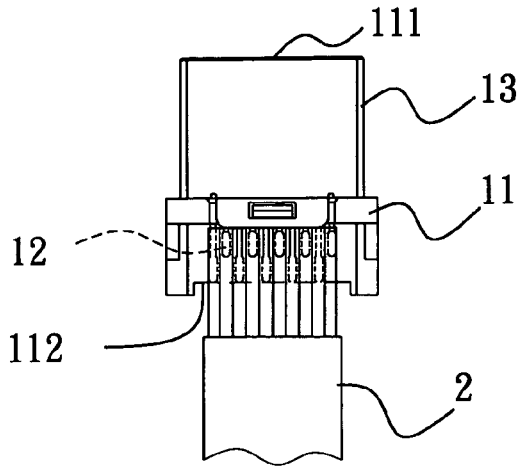
F I G. 1a PRIOR ART
FIGS. 1*a* to 1*c* are schematic sectional views illustrating a fabrication procedure of a conventional electrical connector.
Figure 1B:
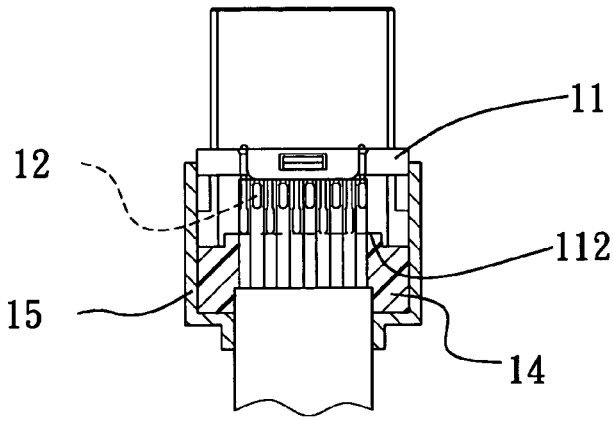
F I G. 1b PRIOR ART
Figure 1C:
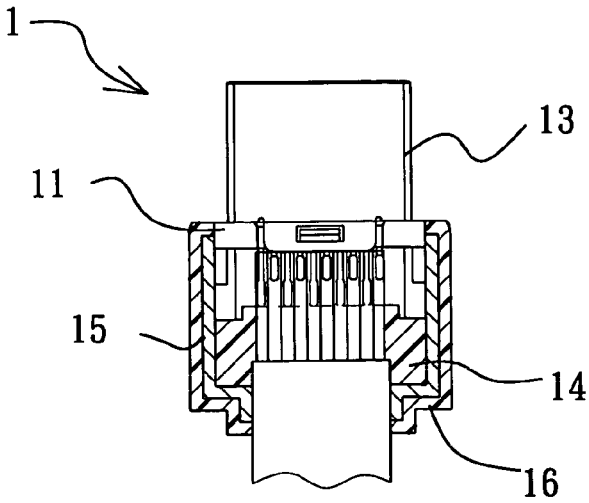
F I G. 1c PRIOR ART

Before the present invention is described in greater detail, it should be noted that like elements are denoted by the same reference numerals throughout the disclosure.

Figure 2:
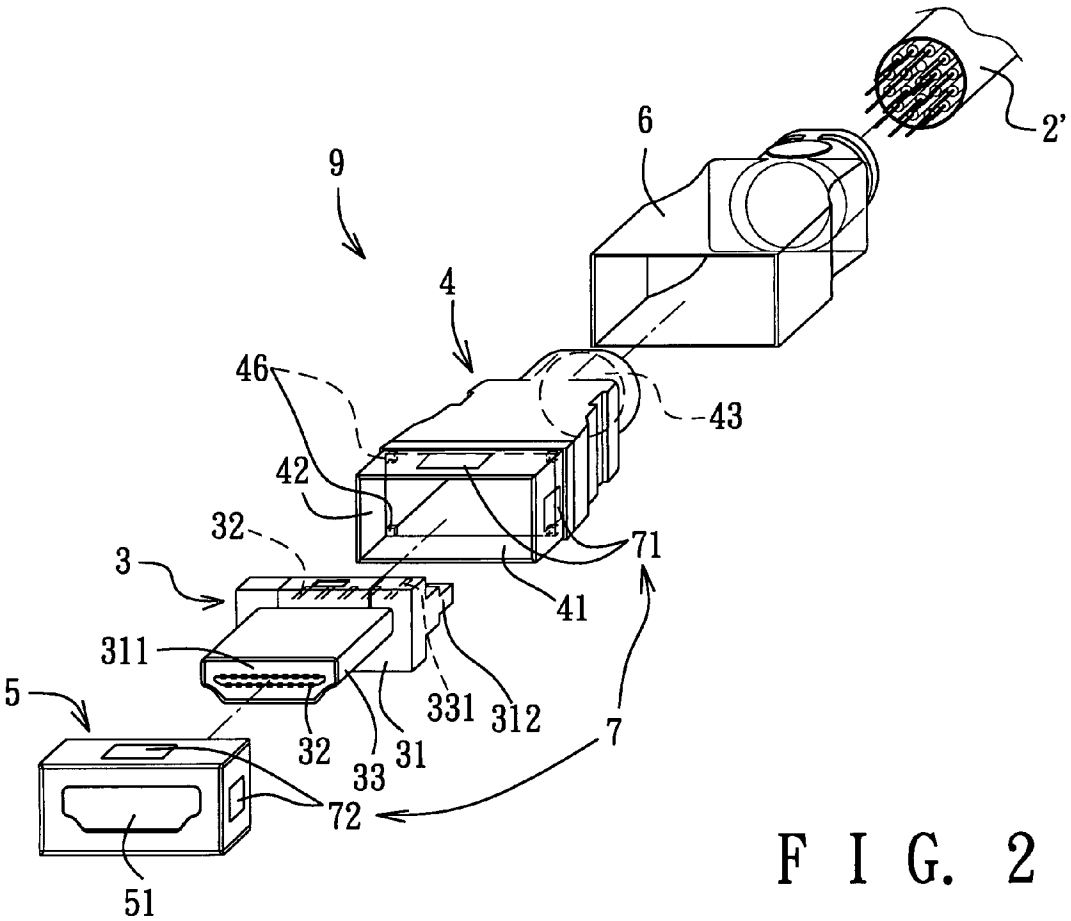
FIG. 2 is an exploded perspective view showing the first preferred embodiment of an electrical connector according to the present invention.
Figure 3:
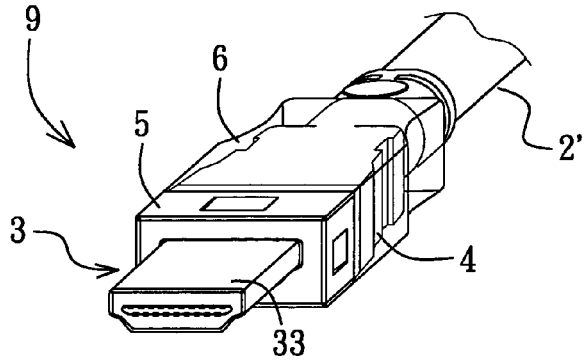
FIG. 3 is an assembled perspective view showing the first preferred embodiment.
Figure 4:
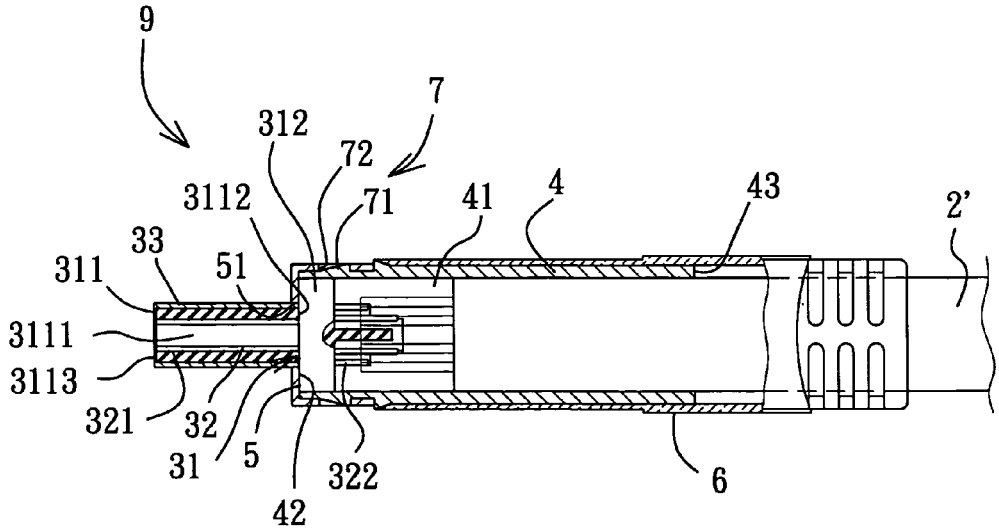
FIG. 4 is a schematic sectional view showing the first preferred embodiment.

Referring to FIGS. 2 to 4, the first preferred embodiment of an electrical connector 9 according to the present invention is shown to include a connecting unit 3, a metal shielding housing 4, an intermediate sleeve 5, and an engaging unit 7.

The connecting unit 3 includes a dielectric seat 31, a plurality of conductive terminals 32, and a metal shielding sleeve 33. The dielectric seat 31 is made of a plastic material, and has a sleeve end portion 311 that is formed with a terminal-receiving space 3111 and that has opposite first and second open ends 3112, 3113 for access into the terminal-receiving space 3111, and a coupling end portion 312 connected fixedly to the first open end 3112 of the sleeve end portion 311 and opposite to the sleeve end portion 311 in this embodiment, as shown in FIG. 4. The conductive terminals 32 are disposed in the terminal-receiving space 3111 in the sleeve end portion 311 of the dielectric seat 31, and are spaced apart from each other. Each conductive terminal 32 has a first conducting end portion 321 extending toward the second open end 3113 of the sleeve end portion 311, and a second conducting end portion 322 opposite to the first conducting end portion 321 and extending outwardly of the second open end 3113 of the sleeve end portion 311 and through the coupling end portion 312 so as to be adapted to be connected electrically to an electrical wire 21', as shown in FIG. 4. The metal shielding sleeve 33 is disposed around and covers the sleeve end portion 311 of the dielectric seat 31. In this embodiment, the metal shielding sleeve 33 has a grounding terminal 331 extending outwardly of the coupling end portion 312 of the dielectric seat 31, as shown in FIG. 2, and adapted to be connected electrically to the electrical wire 2'.

The metal shielding housing 4 is formed by pressing, and is processed by surface electroplating of nickel. The metal shielding housing 4 is formed with an accommodating space 41, and has an opening 42 for access into the accommodating space 41. The metal shielding housing 4 permits extension of the coupling end portion 312 of the dielectric seat 31 into the accommodating space 41 via the opening 42 for connection with the coupling end portion 312 of the dielectric seat 31. In this embodiment, the metal shielding housing 4 further has a plurality of positioning projections 46 disposed in the accommodating space 41 (see FIG. 2) and abutting against the coupling end portion 312 of the dielectric seat 31 when the coupling end portion 312 of the dielectric seat 31 extends into the accommodating space 41. The metal shielding housing 4 further has an open end 43 for access into the accommodating space 41. The open end 43 is adapted to allow for extension of the electrical wire 2' therethrough.

The intermediate metal sleeve 5 is formed by pressing, and is processed by surface electroplating of nickel. The intermediate metal sleeve 5 is connected electrically to both the metal shielding sleeve 33 of the connecting unit 3 and the metal shielding housing 4. The metal shielding sleeve 33 projects from the intermediate metal sleeve 5. In this embodiment, the intermediate metal sleeve 5 has a through hole 51 permitting extension of the sleeve end portion 311 of the dielectric seat 31 and engaging fittingly the metal shielding sleeve 33.

The engaging unit 7 is provided on the metal shielding housing 4 and the intermediate metal sleeve 5 for releasably anchoring the intermediate metal sleeve 5 to the metal shielding housing 4. In this embodiment, the engaging unit 7 includes a plurality of engaging lugs 71 formed on the metal shielding housing 4, and a plurality of engaging holes 72 formed in the intermediate metal sleeve 5 and engaging respectively the engaging lugs 71, as best shown in FIG. 4.

An insulating housing 6 is sleeved on the metal shielding housing 4 in a close fitting manner. The insulating housing 6 can be made of a resilient insulating material, such as PVC, PC, PET and ABS. In this embodiment, the insulating housing 6 is made of transparent PVC mixed with color particles for decorative purposes.

It is noted that, due to the presence of the metal shielding sleeve 33, the metal shielding housing 4 and the intermediate metal sleeve 5 are interconnected electrically, and the dielectric seat 31 mounted with the conductive terminals 32 can be almost entirely shielded. Furthermore, even if there is generated some electromagnetic wave leakage, the electromagnetic wave leakage can be grounded via the grounding terminal 331 of the metal shielding sleeve 33. Therefore, the electrical connector 9 of the present invention can provide an enhanced EMI shielding effect.

On the other hand, each of the metal shielding sleeve 33, the metal shielding housing 4 and the intermediate metal sleeve 5 is integrally formed by pressing, which is a relatively simple procedure as compared to injection molding used in the aforesaid conventional electrical connector. Hence, the size of the electrical connector 9 of the present invention can be reduced to a minimum.

Figure 5:
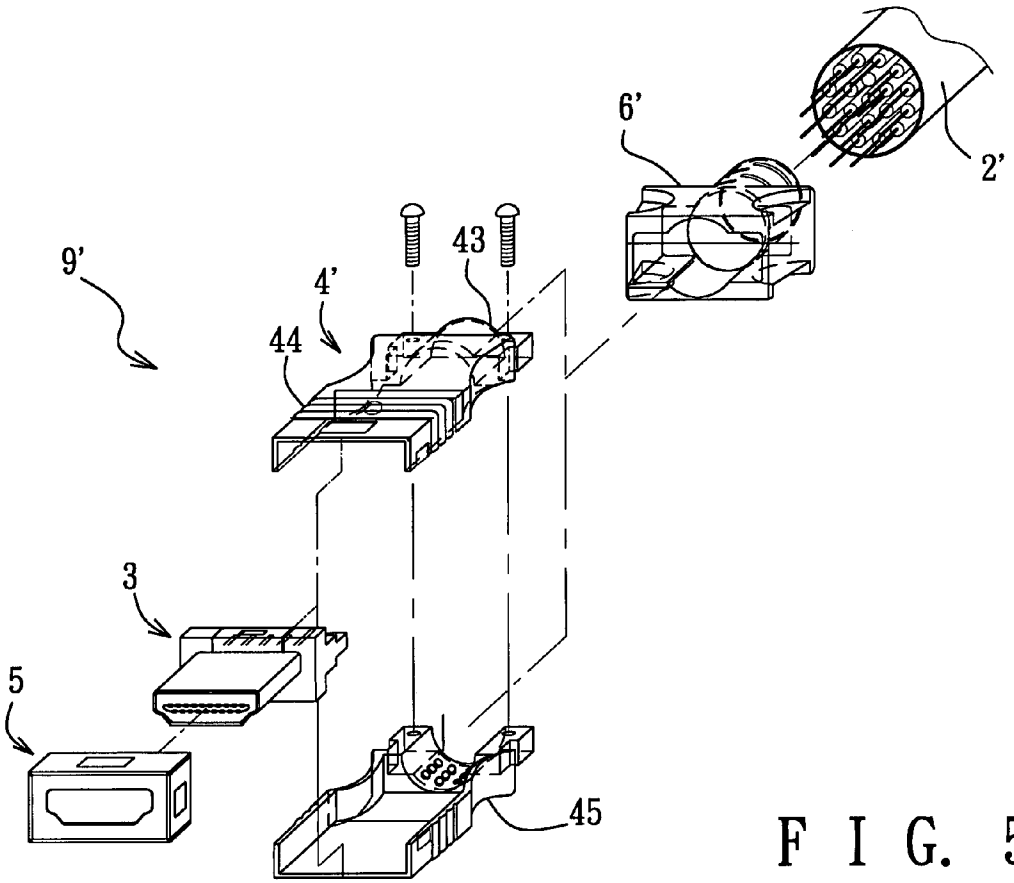
FIG. 5 is an exploded perspective view showing the second preferred embodiment of an electrical connector according to the present invention.

FIG. 5 illustrates the second preferred embodiment of an electrical connector 9' according to this invention, which is a modification of the first preferred embodiment. Unlike the previous embodiment, the metal shielding housing 4' has complementary first and second housing parts 44, 45 that are interconnected removably by means of a plurality of screw fasteners.

Furthermore, the insulating housing 6' is sleeved on the open end 43 of the metal shielding housing 4' for reinforcing connection between the metal shielding housing 4' and the electrical wire 2' when the electrical wire 2' has a larger size.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electrical connector comprising:

a connecting unit including a dielectric seat having a sleeve end portion that is formed with a terminal-receiving space and that has opposite first and second open ends for access into said terminal-receiving space, and a coupling end portion connected fixedly to said first open end of said sleeve end portion, a conductive terminal disposed in said terminal-receiving space in said sleeve end portion of said dielectric seat, said conductive terminal having a first conducting end portion extending toward said second open end of said sleeve end portion, and a second conducting end portion opposite to said first conducting end portion and extending outwardly of said first open end of said sleeve end portion, and a metal shielding sleeve disposed around and covering said sleeve end portion of said dielectric seat;

a metal shielding housing formed with an accommodating space and having an opening for access into said accommodating space, said metal shielding housing permitting extension of said coupling end portion of said dielectric seat into said accommodating space via said opening for connection with said coupling end portion of said dielectric seat; and an intermediate metal sleeve connected electrically to both said metal shielding sleeve of said connecting unit and said metal shielding housing, said metal shielding sleeve projecting from said intermediate metal sleeve.

2. The electrical connector as claimed in claim 1, further comprising an engaging unit provided on said metal shielding housing and said intermediate metal sleeve for releasably anchoring said intermediate metal sleeve to said metal shielding housing.

3. The electrical connector as claimed in claim 2, wherein said engaging unit includes an engaging lug formed on one of said metal shielding housing and said intermediate metal sleeve, and an engaging hole formed in the other one of said metal shielding housing and said intermediate metal sleeve and engaging said engaging lug.

4. The electrical connector as claimed in claim 1, wherein said metal shielding housing has complementary first and second housing parts that are interconnected removably.

5. The electrical connector as claimed in claim 1, wherein said intermediate metal sleeve has a through hole permitting extension of said sleeve end portion of said dielectric seat and engaging fittingly said metal shielding sleeve.

6. The electrical connector as claimed in claim 1, wherein said metal shielding sleeve of said connecting unit has a grounding terminal extending outwardly of said coupling end portion of said dielectric seat.

7. The electrical connector as claimed in claim 1, wherein said sleeve end portion is opposite to said coupling end portion.

8. The electrical connector as claimed in claim 1, wherein said metal shielding housing further has an open end for access into said accommodating space, said open end of said metal shielding housing being adapted to allow for extension of an electrical wire therethrough, said electrical connector further comprising an insulating housing sleeved on said metal shielding housing in a close fitting manner.

* * * * *